US007036598B2

(12) United States Patent
Skjærseth et al.

(10) Patent No.: US 7,036,598 B2
(45) Date of Patent: May 2, 2006

(54) INTERVENTION MODULE FOR A WELL

(75) Inventors: Odd B. Skjærseth, Stavanger (NO); Geir Ueland, Sola (NO)

(73) Assignee: Offshore & Marine AS (NO)

( * ) Notice: Subject to any disclaimer, the term of this patent is extended or adjusted under 35 U.S.C. 154(b) by 0 days.

(21) Appl. No.: 10/362,322

(22) PCT Filed: Aug. 20, 2001

(86) PCT No.: PCT/NO01/00342

§ 371 (c)(1),
(2), (4) Date: Jun. 16, 2003

(87) PCT Pub. No.: WO02/20938

PCT Pub. Date: Mar. 14, 2002

(65) Prior Publication Data

US 2004/0094305 A1 May 20, 2004

(30) Foreign Application Priority Data

Aug. 21, 2000 (NO) ..... 20004177

(51) Int. Cl.
*E21B 29/12* (2006.01)

(52) U.S. Cl. ..... 166/339; 166/365; 166/75.15

(58) Field of Classification Search ..... 166/339, 166/360, 365, 70, 383, 75.15; 137/268; 623/47, 623/48, 49, 50, 51, 52, 53, 55
See application file for complete search history.

(56) References Cited

U.S. PATENT DOCUMENTS 1,289,580 A * 12/1918 Vincenti ..... 623/52

(Continued)

FOREIGN PATENT DOCUMENTS

| | | |
|---|---|---|
| GB | 2173532 | 10/1986 |
| GB | 2375785 | 11/2002 |
| GB | 2385872 | 9/2003 |
| WO | 98/14686 | 4/1998 |
| WO | 99/63196 | 12/1999 |

*Primary Examiner*—Heather Shackelford
*Assistant Examiner*—Thomas A Beach
(74) *Attorney, Agent, or Firm*—Andrus, Sceales, Starke & Sawall, LLP

(57) ABSTRACT

The invention relates to an intervention module (18) for well intervention operations in preferably a pressurized subsea well (2) with a wellhead (4) disposed on a water floor. The intervention module (18) is provided with necessary equipment to replace, under water, intervention tools (54) and thereby perform several well intervention operations in one run, without the supply of equipment from a surface vessel. The module (18) is lowered from a surface vessel and placed on the wellhead (4), possibly a BOP (12), of the well (2). The intervention module (18) is connected to the surface vessel through a connecting line/hose or a wireless connection which communicates, as a minimum, necessary control and feed-back signals. The module (18) is provided with i.e. a rotatable tool magazine (38) arranged with several storage pipes (52) for intervention tools (54), the relevant storage pipe (52) being rotatable into a position immediately above the well bore (24) of the well (2), after which the intervention tool (54) is connected to a supply string (32), whereas the storage pipe (52) is connected in a pressure-sealing manner to the well bore (24) below and a pressure safety device above, through which the supply string (32) is passed, so that the intervention tool (54) may be inserted safely into the well (2).

19 Claims, 8 Drawing Sheets

U.S. PATENT DOCUMENTS 2,713,909 A * 7/1955 Baker ..... 166/70
3,674,123 A * 7/1972 Lewis et al. ..... 193/23
3,871,032 A * 3/1975 Karas ..... 623/26
4,174,011 A * 11/1979 Zaremba ..... 175/7
4,291,724 A * 9/1981 Miller ..... 137/555
4,444,275 A * 4/1984 Beynet et al. ..... 175/7
4,785,880 A * 11/1988 Ashton ..... 166/53
5,139,525 A * 8/1992 Kristinsson ..... 623/55
5,188,178 A * 2/1993 Noyes ..... 166/310
5,244,046 A 9/1993 Council et al.
5,258,038 A * 11/1993 Robinson et al. ..... 623/49
5,813,455 A * 9/1998 Pratt et al. ..... 166/75.15
5,957,981 A * 9/1999 Gramnas ..... 623/47
6,039,122 A * 3/2000 Gonzalez ..... 166/379
6,044,905 A * 4/2000 Harrison, III ..... 166/75.15
6,116,345 A 9/2000 Fontana et al.
6,182,765 B1 * 2/2001 Kilgore ..... 166/381
6,187,052 B1 * 2/2001 Molino et al. ..... 623/52
6,269,875 B1 * 8/2001 Harrison, III et al. ..... 166/53
6,336,238 B1 * 1/2002 Tarlton ..... 15/3.5
6,454,011 B1 * 9/2002 Schempf et al. ..... 166/381
6,478,089 B1 * 11/2002 Alves et al. ..... 166/310
6,488,093 B1 12/2002 Moss
6,533,032 B1 * 3/2003 Seixas et al. ..... 166/70
6,581,698 B1 * 6/2003 Dirks ..... 175/52
6,675,888 B1 * 1/2004 Schempf et al. ..... 166/65.1
6,763,889 B1 7/2004 Rytlewski et al.
6,808,021 B1 * 10/2004 Zimmerman et al. ..... 166/381
2002/0066556 A1 * 6/2002 Goode et al. ..... 166/53
2003/0178200 A1 * 9/2003 Fox et al. ..... 166/341

* cited by examiner

INTERVENTION MODULE FOR A WELL

CROSS REFERENCE TO RELATED APPLICATION

The present application is the U.S. national stage application of International Application PCT/NO01/00342, filed Aug. 20, 2001, which international application was published on Mar. 14, 2002 as International Publication WO 02/20938. The International Application claims priority of Norwegian Patent Application 20004177, filed Aug. 21, 2000.

FIELD OF THE INVENTION

The invention relates to a frame assembly of intervention equipment for a well, e.g. a petroleum well, the frame assembly being referred to hereinafter as an intervention module. The intervention module is used preferably, but not necessarily, in connection with a subsea well, in which the wellhead is disposed on a water floor, for example a sea floor. Alternatively, the intervention module may be used in connection with wellheads placed in a surface position on shore or above water. Such intervention equipment is used to perform different types of downhole well operations, the well normally being pressurized.

BACKGROUND OF THE INVENTION

The background of the invention is the drawbacks in terms of time and cost connected with known well intervention techniques, and in particular in connection with intervention in subsea wells.

KNOWN TECHNIQUE

In completed wells, e.g. in connection with the recovery of hydrocarbons, it may be necessary at times to perform various types of working operations downhole.

The purpose of such working operations, or well interventions, may vary. Normally an intervention is carried out with the aim of disposing or removing components and equipment in the well, e.g. plugs/packers or valves, or with the aim of performing various measurements in the well, for example measuring of internal pipe diameter or measuring of production parameters in the well, possibly of perforating casing or tubing within the well. Typically, the intervention is carried out when the well is pressurized, for example by production of formation fluids.

Known intervention technique for a subsea well normally assumes the use of a mobile drilling device which is positioned above a well location. Especially by greater water depths it may be necessary to use a floating drilling device, e.g. a drilling rig or a drill ship, such a drilling device often being kept in the correct location by means of dynamic positioning equipment.

A connection between the drilling device and the subsea well is normally constituted by a riser connected to a blow-out preventer (BOP) below, these being lowered from the drilling device and connected to the wellhead of the well. Subsequently the intervention tool is lowered trough the riser on a flexible supply string, through the BOP and wellhead, further down into the well to perform the operation in question. The supply string that the intervention tool is connected to, is formed, for example, of a wire (slickline, wireline) or coiled tubing, the supply string being coiled on a drum. When the intervention tool is being lowered into the well, the string is supplied from the drum by means of an injector as it is being lowered from the drilling device.

Conversely, when the intervention tool is lifted from the well, the supply string is coiled onto the drum. In this connection the drilling device is provided additionally with at least one pressure safety device, e.g. a lubricator/stripper, through which the supply string is passed during the intervention work, the securing device forming a pressure barrier between the pressurized well and the surface environment.

In connection with such intervention work successive and/or different intervention operations are often carried out, and it may be necessary in each intervention operation to use another and/or different intervention tool. Therefore, on the surface it will be necessary, possibly for each intervention operation, to change the intervention tool, after which the supply string is run in and out of the well for every intervention operation.

DRAWBACKS OF KNOWN TECHNIQUES

The most obvious drawback of known intervention techniques is that a mobile/floating drilling device is normally used to carry out the necessary intervention operation or operations in a subsea well. Normally hiring and using such drilling devices involves great cost.

Another drawback of mobile/floating drilling devices is that operations are often limited by weather-dependent conditions, mainly wave height and wind force, so that a large portion of the contracting time may be spent in waiting for better weather conditions, the contracting costs thereby increasing.

To a great degree such weather-dependent stops in the operations are related to the presence of a riser connecting the drilling device with the subsea well. In strong wind and/or great wave movements, and thereby great movement of the drilling device, the riser will have to be disconnected. Thereby all types of well operations carried out through the riser, including intervention operations, stop, and the use of a riser connection between the well device and the subsea well is therefore a disadvantage. Besides, the initial installation and the final removal of a riser are time-consuming and thereby cost-driving.

In connection with subsea wells the intervention tool and the supply string must be lowered through the rinser from the drilling device on the surface to the wellhead/BOP on the water floor, in order then for intervention work to be carried out. By possible replacement of the intervention tool, the intervention tool and the supply string must then be lifted all the way up to the surface. The extra time, and thereby extra cost, spent on running the intervention equipment in and out through the riser, represent a further drawback of known intervention techniques, especially by greater water depths.

OBJECT OF THE INVENTION

The object of the present invention is to provide an intervention module for a well, for example a petroleum well, the use of such an intervention module avoiding the above-mentioned drawbacks.

REALIZATION OF THE OBJECT

According to the invention the object is realized through the use of the intervention module concerned in connection with a well, preferably a subsea well, said intervention module being disposed in a column on top of the BOP or the wellhead, preferably on a water floor. In connection with a subsea well the intervention equipment of the module is connected, in its position of use, to a surface vessel only through a connecting line/hose, possibly a wireless connection, the connection communicating, as a minimum, control and feed-back signals, possibly also acquired well data from an intervention tool disposed in the well, e.g. a logging tool, between the intervention module and the surface vessel. When a connecting line/hose is used, the intervention equipment may additionally be supplied with a driving force, for example electrical or hydraulic power. Moreover, a remotely operated vehicle (ROV) may be used, for example, to assist in the lowering of the intervention module in water and the positioning of it on top of the BOP or wellhead, possibly also to activate, observe and/or supplement devices and equipment of the intervention module. As an alternative, possibly as a supplement, to the use of a remotely operated vehicle, the intervention module may be provided with a suitable number of propulsion units, for example thrusters, allowing the intervention module to be placed in the correct position on top of the BOP or wellhead.

In addition, the module may be provided with, for example, auxiliary devices, back-up devices and possibly emergency equipment, for example oil pressure accumulators, pumps, valves, control equipment and signal transceivers to drive, control, monitor or secure the primary intervention equipment of the module and possible pressure safety devices in the BOP and/or wellhead. Such equipment and technique are known to those skilled in the art of well technology and operations and will not be described more thoroughly in the following description.

The intervention module is formed by a suitable module frame provided with the intervention equipment required. The module frame is arranged to be lowered over and connected to the wellhead, possibly the BOP, which is preferably placed on the water floor, the module frame being provided with a releasable well connecting device at its lower portion, preferably of a hydraulic kind, allowing the intervention module to be connected in a pressure-sealing manner to the well bore of the wellhead, possibly the BOP.

The primary intervention equipment comprises, i.a., a flexible supply string, e.g. a wire (slickline, wireline), coiled tubing or a composite string, which is coiled by its upper end on a drum. The wire or composite string may possibly be provided with electrical lines for the transmission of e.g. electrical signals or electrical power. At the opposite and free end of the supply string, the supply string has a suitable intervention tool attached thereto, e.g. a logging tool, a tool for measuring internal pipe diameter (drift tool), a well plug or a section packer. The supply string is run onto or out from the drum by means of an injector.

Additionally, the intervention module is provided with a rotatable tool magazine for the storing of a suitable number of downhole intervention tools. The tool magazine is formed of two preferably circular and parallel end plates placed in a horizontal, or approximately horizontal, position in the position of use, the end plates being connected to each other, spaced apart, by means of a central rotary shaft, the rotary shaft being rotatable about its longitudinal axis, and the rotary shaft having a suitable rotary device arranged thereto, for example a gear connection driven by a hydraulic or electric motor. In addition, along their circumferences the end plates have one or more longitudinal storage pipes connected thereto, extending through the end plates, and each storage pipe may contain one downhole intervention tool, the storage pipes being placed, in their position of use, in a vertical, or approximately vertical, position and between said end plates. The upper and open end portions of the storage pipes may, if desired, be protected against possible falling objects by means of an above-lying and separate protective plate.

Prior to a particular intervention operation the above-mentioned rotary device is activated and the tool magazine rotated until the storage pipe containing the relevant intervention tool is brought into a position above, and in the extension of, the well bore of the wellhead and a possible BOP. In this connection the free end of the supply string is connected by means of a releasable connecting device to the upper end of the intervention tool in question, which is disposed in the active storage pipe.

During the intervention operation the active storage pipe should form both an extension and a termination of said well bore and, for that reason, it must be arranged to withstand the relevant well pressure. Therefore, in this connection it is absolutely necessary that the supply string is passed through a pressure safety device, for example a lubricator/stripper, which effectively prevents the well pressure from being directed outside the active storage pipe. In order to allow the tool magazine to be rotated between successive intervention operations, the above-lying supply string and pressure safety device, and the well bore below must be disconnected from any storage pipe. This assumes at the same time, that the active storage pipe must be connectable to the pressure safety device and the well bore in a releasable and pressure-sealing manner. This may be done, for example, in that either end portion of each storage pipe is provided with a displaceable, releasable and pressure-sealing pipe connecting device, which is arranged to fit or be arranged, at the upper end portion of the storage pipe, to said pressure safety device, whereas the lower end portion of the storage pipe is arranged to match said well bore of the upper portion of the wellhead and a possible BOP. Each pipe connecting device may be formed, for example, by a coupling sleeve which is displaceable longitudinally of the storage pipe, and which is pushed when being connected, by means of, for example, at least one hydraulic cylinder, over and around a pipe socket arranged to the pressure safety device and also to the well bore of the BOP/wellhead. Besides, the pipe sockets and/or the coupling sleeves are provided with suitable external seals which provide, in their position of use, the necessary pressure-sealing connections.

Moreover, each storage pipe must be arranged with at least one releasable tool anchoring device preventing the intervention tool from falling out of the storage pipe when the tool is not used. The tool anchoring device(s) is (are) arranged in such a manner that it/they may be released from the intervention tool in connection with the connecting of the pipe coupling devices to the adjacent pipe sockets and, conversely, that the intervention tool may be anchored to the storage pipe in connection with the disconnection of the pipe coupling devices from said pipe sockets. Such a releasable tool anchoring device may be arranged, for example, to one of the pipe coupling devices of the storage pipe. The connecting of the pipe sockets and the active storage pipe is carried out after the supply string and the intervention tool have been connected.

When being lowered into water, the intervention module may have been prepared, for example, for an intervention operation after the module has been connected to the wellhead, possibly the BOP. This involves that when being lowered into water, the supply string is connected to the relevant intervention tool, and that said pressure safety device, e.g. a lubricator/stripper, is pressure-sealingly connected to the active storage pipe by means of a pipe connecting device. Upon positioning of the module on top of the wellhead, possibly the BOP, it will therefore only be necessary to connect the active storage pipe to the well bore of the BOP/wellhead before the intervention operation is started in the well.

Should it be necessary, during the intervention work, to replace the intervention tool, the supply string and the intervention tool attached thereto are pulled out of the well until the intervention tool is positioned in the active storage pipe. Then the BOP is closed, the lower pipe connecting device of the storage pipe is disconnected from the well bore, the intervention tool is disconnected from the supply string, the supply string is pulled out of the storage pipe, the upper pipe connecting device of the storage pipe thereby being disconnected from the pressure safety device of the module and the supply string. The tool magazine of the module is then rotated until one of the inactive storage pipes containing another intervention tool is positioned in an active position in the extension of the well bore of the BOP/wellhead. The connecting of the new intervention tool is done by reversing the above-mentioned method of disconnecting, after which a new well intervention operation may be carried out.

In well intervention jobs the need may arise for using more intervention tools than the tool magazine of the intervention module can hold. This problem may be solved in that one or more of the intervention tools are replaced by other intervention tools. In order to carry out the replacement (loading) in a satisfactory way, the intervention module should be provided with at least one connecting device, in the following referred to as a tool loader, placed in an immediate above-lying position relative to at least one inactive storage pipe. The tool loader should facilitate the insertion or extraction of an intervention tool into/from the storage pipe. Additionally, the tool loader should be arranged with a valve device which may be opened/closed as required, so that unwanted objects cannot fall into the inactive storage pipe when its upper and open end portion is placed immediately under the tool loader. Intervention tools replaced in this way may be lifted to or lowered by a wire from the surface vessel the loading of the intervention tool being assisted by a remotely operated vehicle.

ADVANTAGES OF THE INVENTION

As earlier mentioned, the intervention module according to the invention is used without the establishment of a riser connection between the surface and the water floor. In well intervention jobs it is thereby possible to use other floating surface vessels than the traditional mobile/floating drilling devices which are often used in this connection. Such alternative surface vessels, for example a boat or a barge, are usually smaller in size and/or provided with less comprehensive technical equipment. On the other hand, an alternative surface vessel may still have been provided or be provided with, adequate technical equipment for performing well intervention work with an intervention module according to the invention. Such a vessel is normally substantially more inexpensive to hire and use than a conventional mobile/floating drilling device.

By the fact that a riser connection is avoided, the drawbacks in terms of time and cost otherwise incurred in installing and disassembling the riser, are avoided. Additionally, stops in the operations caused by weather conditions, which would otherwise have necessitated disconnection of the riser, are avoided to a great degree. According to the invention the intervention module is connected to the surface vessel only through a connecting line/hose, possibly by a wireless connection, which entails a substantially greater operative flexibility and continuity than when a conventional mobile/floating drilling device is used.

After the intervention module has been placed on a water floor, and in connection with the fact that it is desired to perform a replacement of an intervention tool, it will be unnecessary, according to the invention, to lift the intervention tool and the supply string all the way up to the surface to perform said replacement, and thereby no extra time and cost are spent on this lifting operation, which is important, in particular by greater water depths.

BRIEF DESCRIPTION OF THE FIGURES OF THE DRAWINGS

In the following part of the description, referring to the FIGS. 1–16, reference will be made to a non-limiting exemplary embodiment of the invention, in which one particular reference numeral refers to the same detail in all drawings where this detail is indicated, and wherein

FIG. 11 shows a horizontal section through the tool loader shown in FIG. 10, the Figure of the drawing also showing the vertical section line X—X, cf. FIG. 10;

FIG. 15, whereas FIG. 15 shows the vertical section line XIV—XIV, cf. FIG. 14.

The figures of the drawings may otherwise be somewhat distorted with respect to sizes and lengths.

DESCRIPTION OF EXEMPLARY EMBODIMENTS OF THE INVENTION

Figure 1:
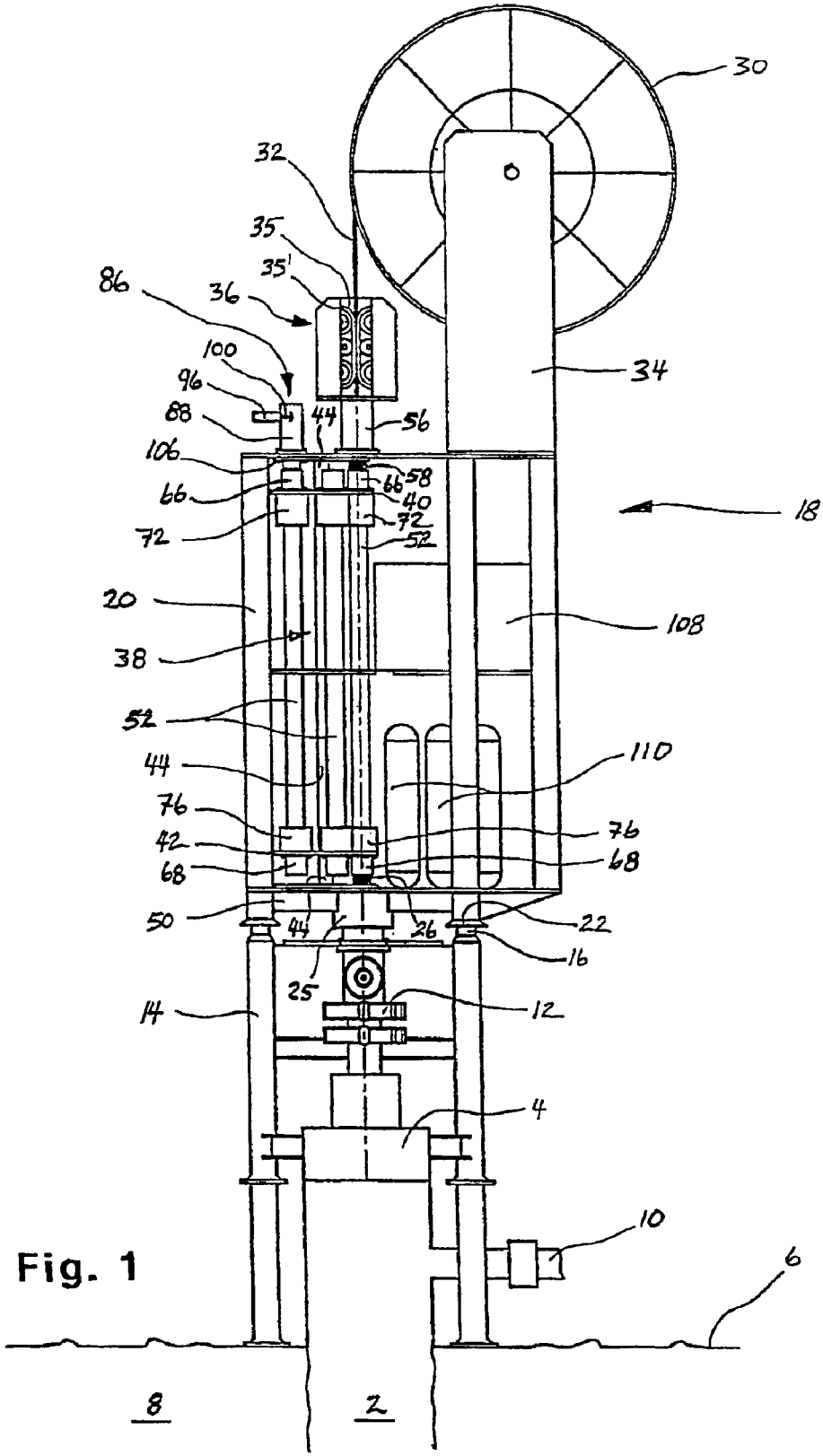
FIG. 1 shows a view of the intervention module placed on a water floor on top of a BOP and a wellhead belonging to a subsea well.
Figure 16:
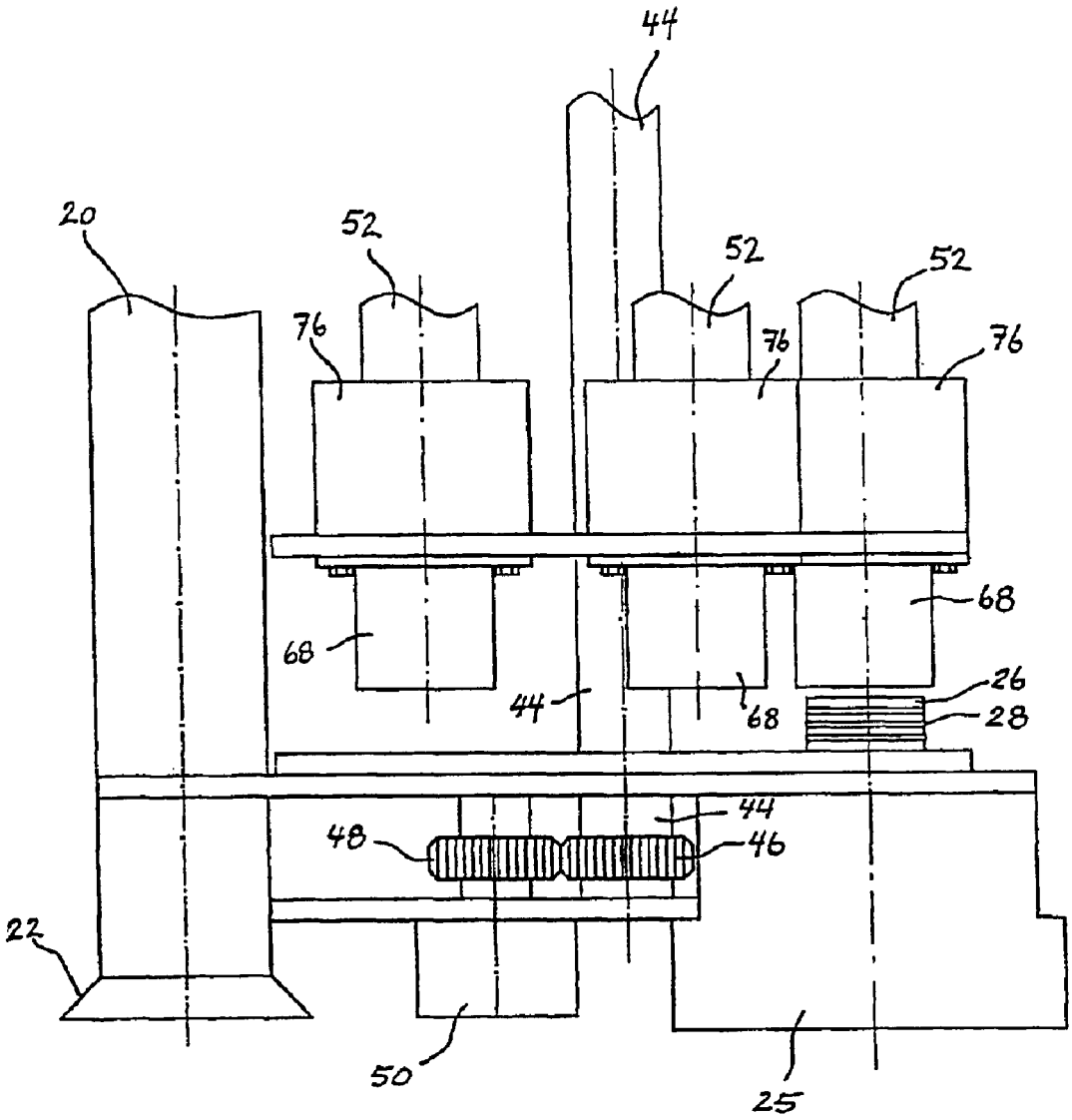
FIG. 16 shows a section of the intervention module shown in FIG. 1, the Figure of the drawing visualizing, i.a., partly in a vertical section, the rotary device of the intervention module, the rotary device being able to rotate the tool magazine of the intervention module.

FIG. 1 shows a subsea well 2 extending from a wellhead 4 disposed on an ocean floor 6 into the underground 8. The wellhead 4 has a production line 10 and an above-lying BOP 12 connected thereto. The subsea well 2 is moreover subjected to formation pressure. Externally the wellhead 4, possibly the BOP 12, is formed with a module receiving frame 14 which is provided with four guide poles 16. An intervention module 18 according to the invention is shown placed on top of the module receiving frame 14, the intervention module 18 being formed, i.a., by a module frame 20 provided with four guide shoes 22 at its lower end, matching the guide poles 16 of the module receiving frame 14 when being assembled. Moreover, the wellhead 4 and the BOP 12 are formed with a through well bore 24, which is arranged to be connected at its upper end in a pressure-sealing manner to a hydraulic well coupling sleeve 25 arranged to the lower portion of the module frame 20, cf. FIG. 16. At its upper portion the hydraulic well coupling sleeve 25 is moreover arranged with a pipe socket 26, the pipe socket 26 being provided externally with pressure-sealing seals 28.

Figure 2:
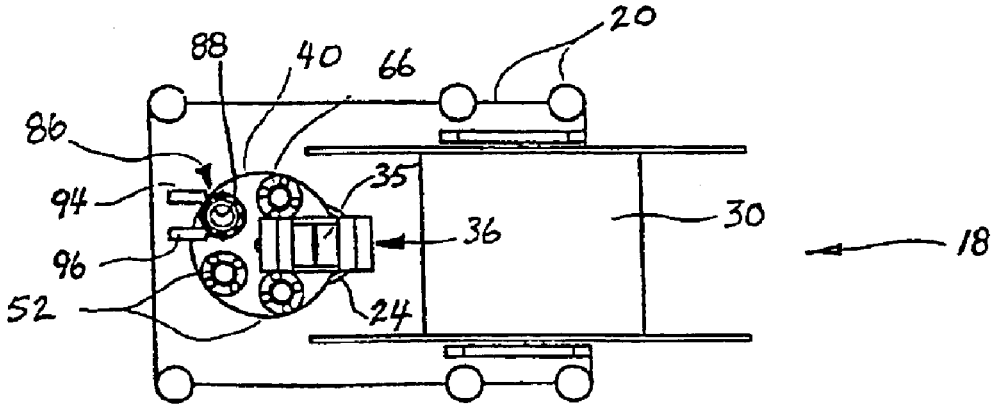
FIG. 2 shows a plan view of the intervention module shown in FIG. 1.
Figure 3:
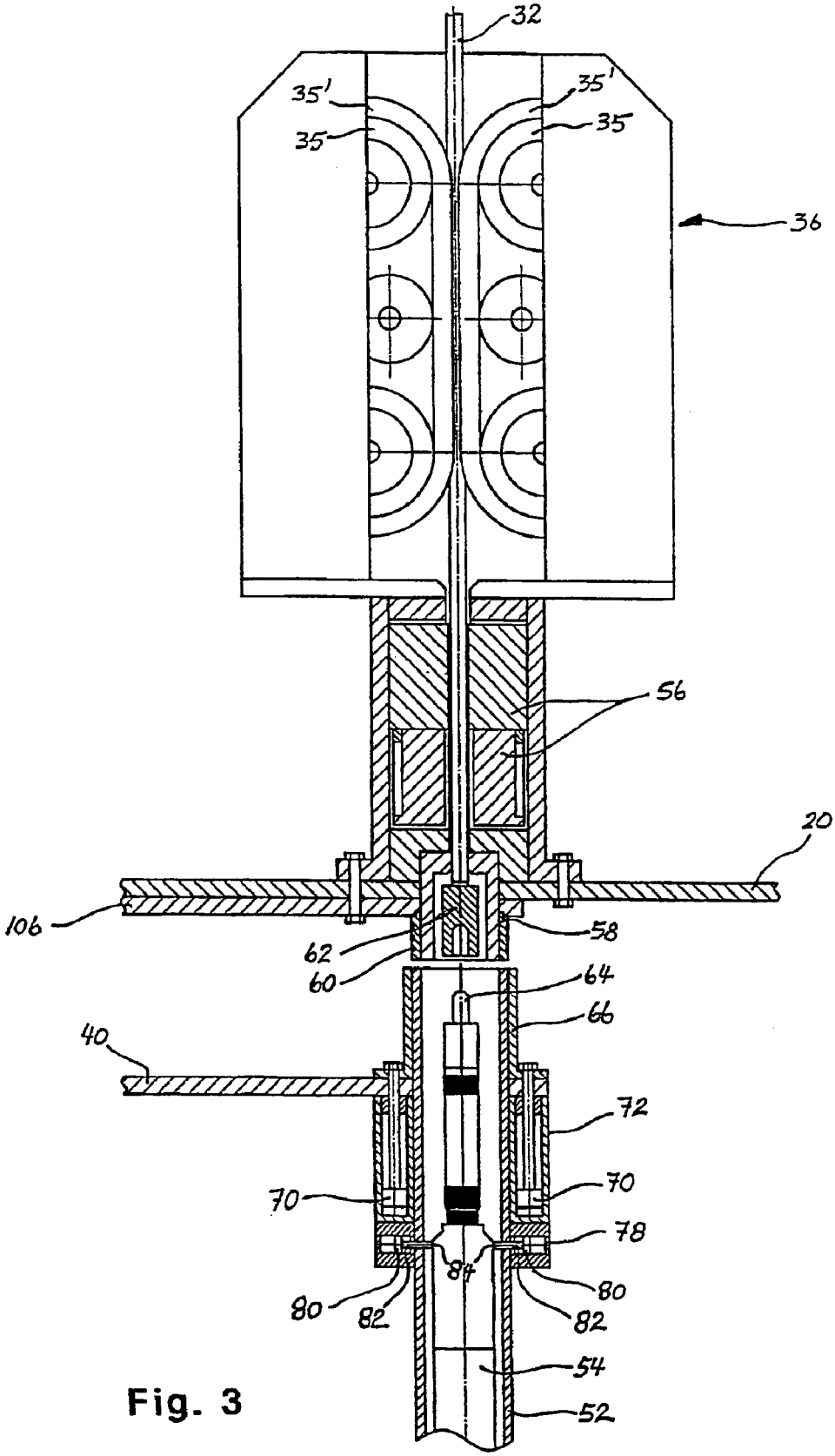
FIG. 3 shows a section of the intervention module shown in FIG. 1, the Figure of the drawing visualizing, partially in a vertical section, the injector of the intervention module, supply string, lubricator/stripper, the supply string connecting device with an intervention tool, a storage pipe provided with a displaceable, releasable and pressure-sealing coupling sleeve, which is arranged to fit or be arranged to said lubricator/stripper, and a releasable tool anchoring device arranged to the storage pipe, the intervention tool being placed in a locked position within the storage pipe, but the storage pipe being shown disconnected from the lubricator/stripper above.
Figure 4:
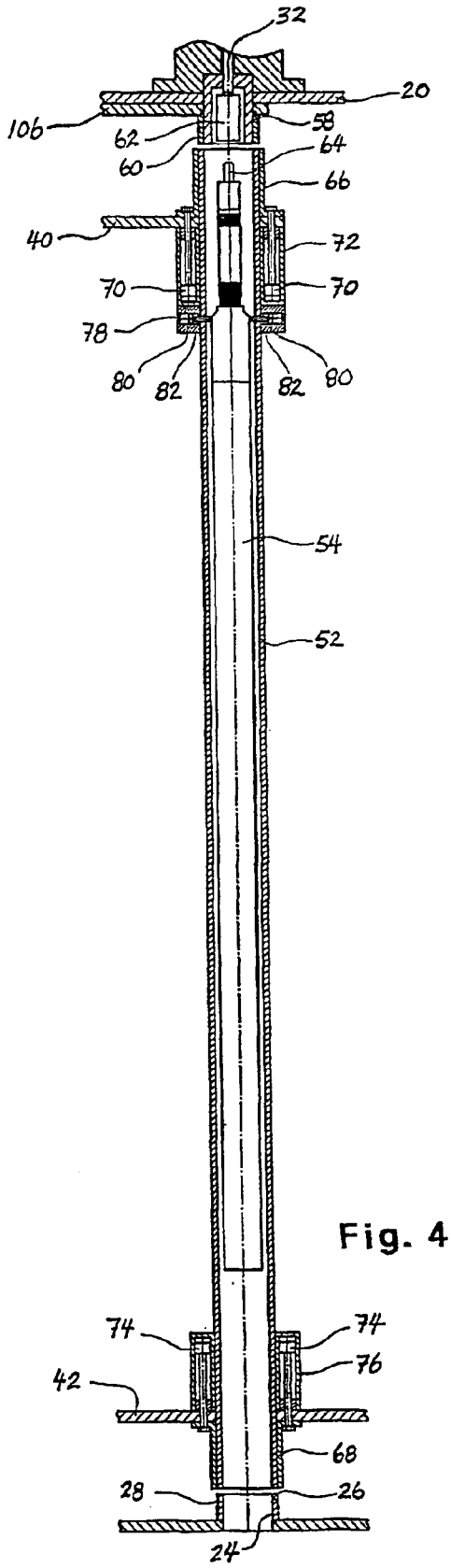
FIG. 4 shows a section of the intervention module shown in FIG. 1, the Figure of the drawing visualizing a vertical section through a storage pipe disposed above and in the extension of the well bore of the subsea well, the storage pipe being provided with a displaceable, releasable and pressure-sealing coupling sleeve at either end portion, the coupling sleeves being shown disconnected from both the lubricator/stripper above and the well bore below, and the supply string being shown disconnected from the intervention tool, the intervention tool, however, being placed in its locked position within the storage pipe.
Figure 5:
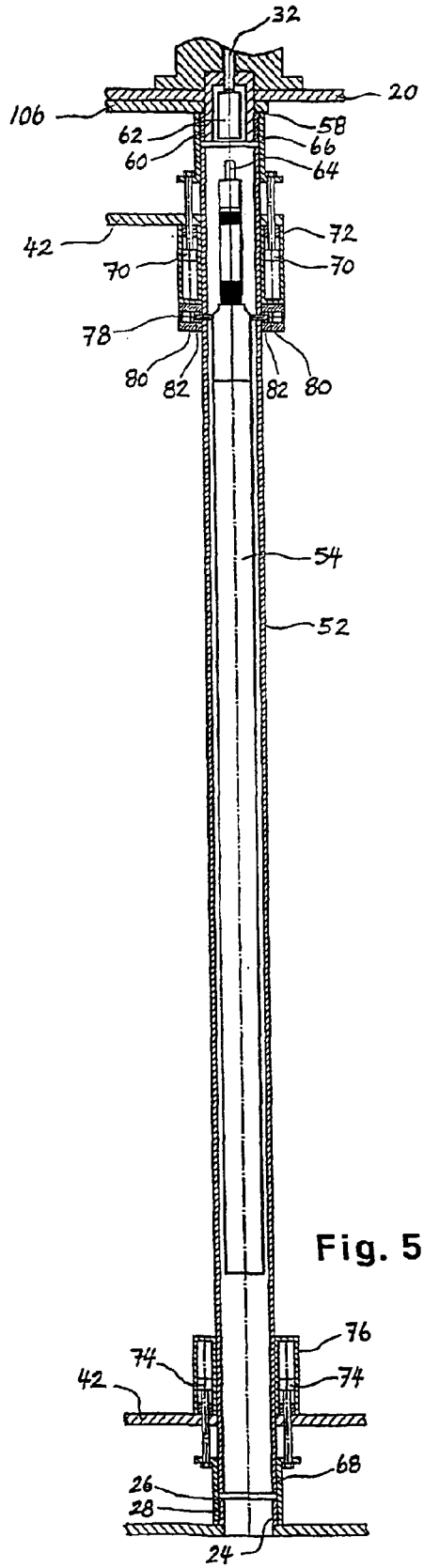
FIG. 5 also shows a vertical section of the storage pipe shown in FIG. 4, the coupling sleeves being connected, however, to both the lubricator/stripper above and the well bore below, and said supply string still being disconnected from the intervention tool, the intervention tool still being placed in its locked position within the storage pipe.
Figure 6:
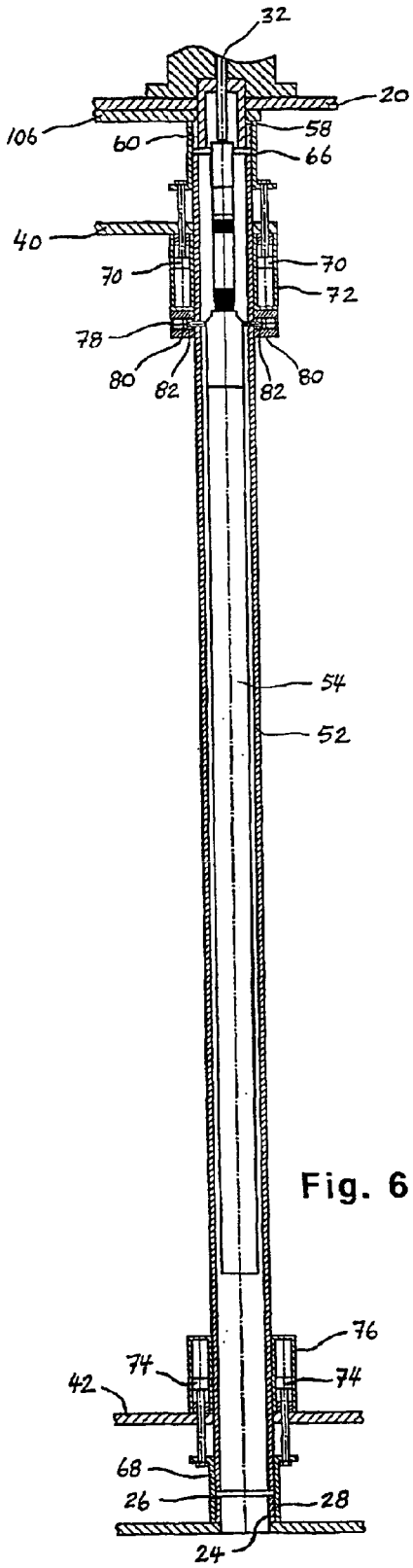
FIG. 6 shows, like FIG. 5, a vertical section of the storage pipe, the coupling sleeves being connected to the lubricator/stripper and the well bore, the intervention tool still being disposed in its locked position in the storage pipe, the supply string, however, being connected to the intervention tool.
Figure 7:
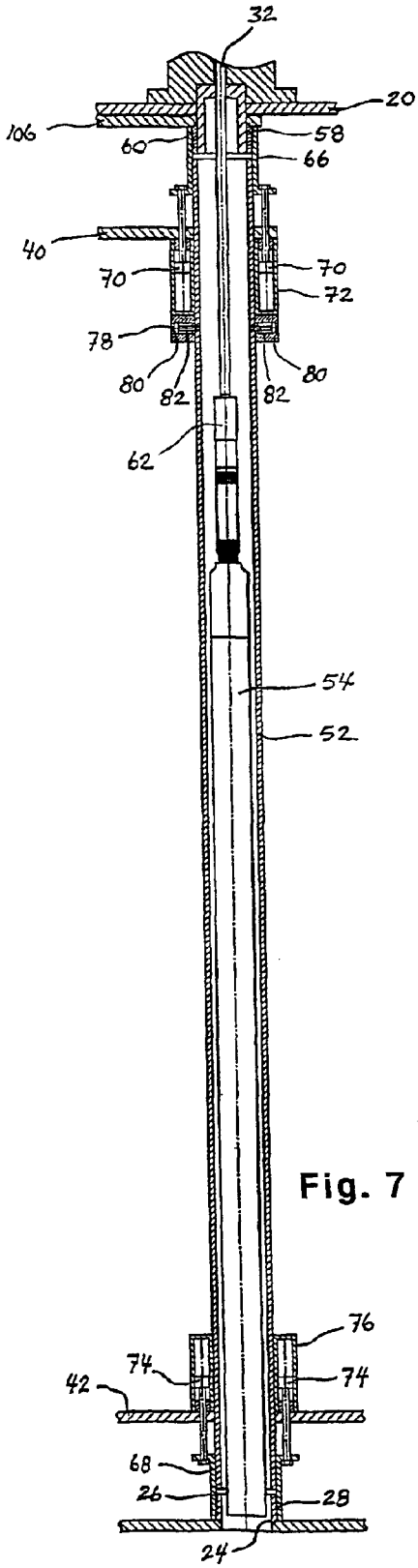
FIG. 7 shows, like FIG. 6, a vertical section of the storage pipe, the coupling sleeves being connected to the lubricator/stripper and the well bore, and the supply string being connected to the intervention tool, the intervention tool being placed, however, in a released position within the storage pipe, the intervention tool being about to be lowered out of the storage pipe and further down into the subsea well.
Figure 8:
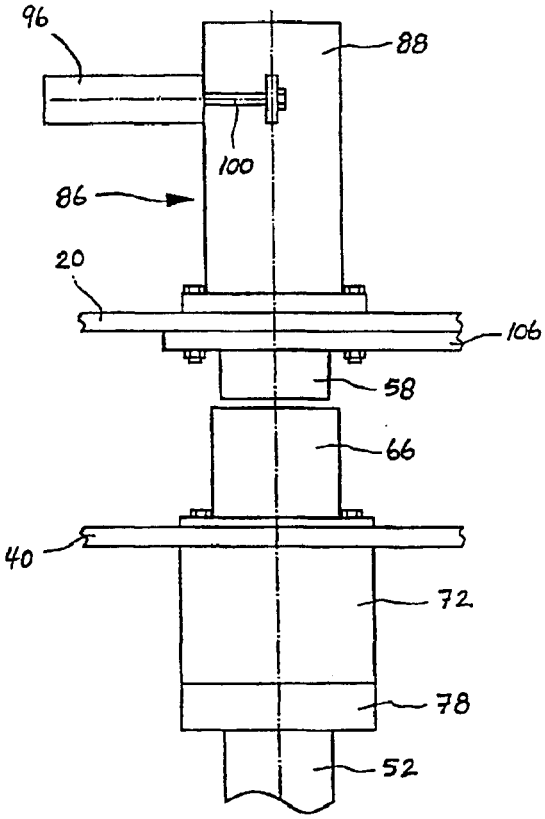
FIG. 8 shows a section of the intervention module shown in FIG. 1, the Figure of the drawing visualizing a view of the tool loader of the intervention module placed in an immediate above-lying position relative to an inactive storage pipe, the two hydraulic cylinders of the tool loader being shown placed in a position in which the gate valve of the tool loader is closed.
Figure 10:
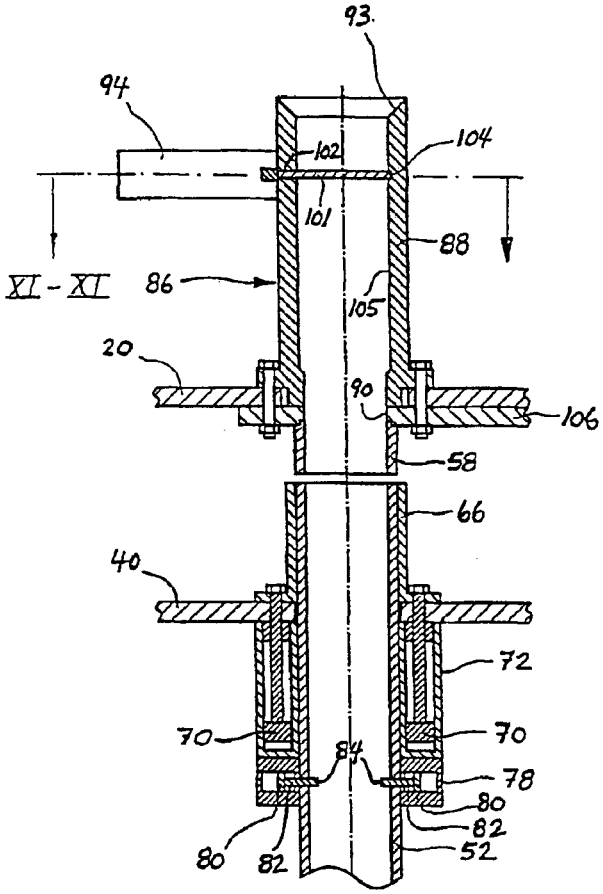
FIG. 10 shows a vertical section through the tool loader shown in FIG. 8, the plate-shaped body of the gate valve being shown in a position pushed all the way into the loading pipe of the tool loader, the end portion of the body bearing in this position on the internal pipe bore of the loading pipe and closing the pipe bore, the Figure of the drawing also showing the horizontal section line XI—XI, cf.
Figure 9:
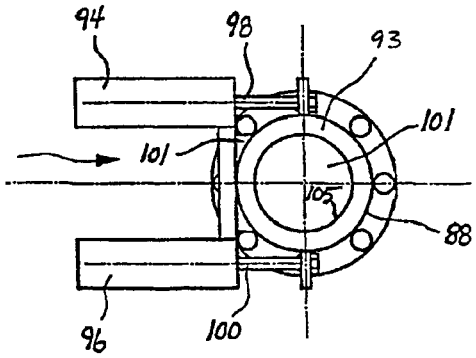
FIG. 9 shows a plan view of the tool loader shown in FIG. 8.
Figure 11:
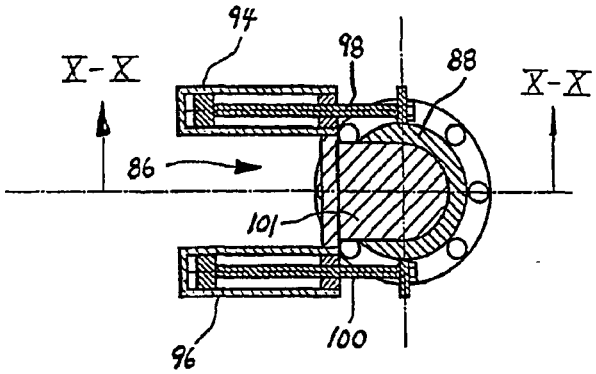
FIG. 11.
Figure 12:
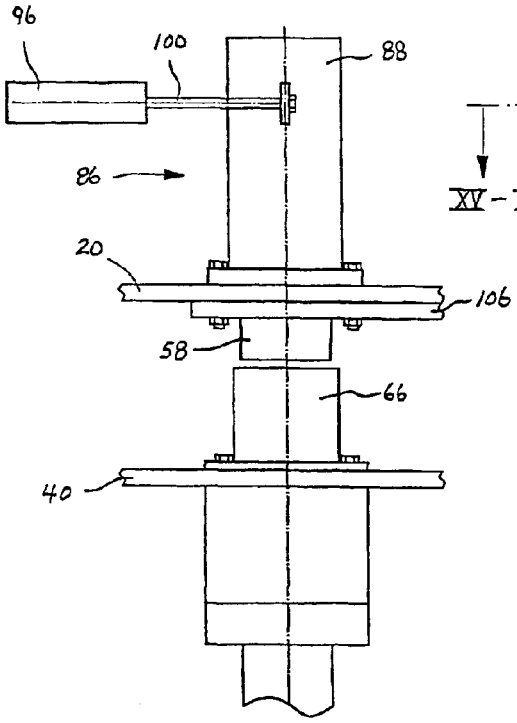
FIGS. 12, 13, 14 and 15 show, like the FIGS. 8, 9, 10, and 11, respectively, a corresponding view, plan view, vertical section and horizontal section of the tool loader, but the two hydraulic cylinders of the tool loader are shown placed in a position, in which the gate valve of the tool loader is open, and in which the plate-shaped body of the gate valve is shown pulled completely out of the loading pipe of the tool loader, the internal pipe bore of the loading pipe thereby being open, FIG. 14 also showing the horizontal section line XV—XV, cf.
Figure 14:
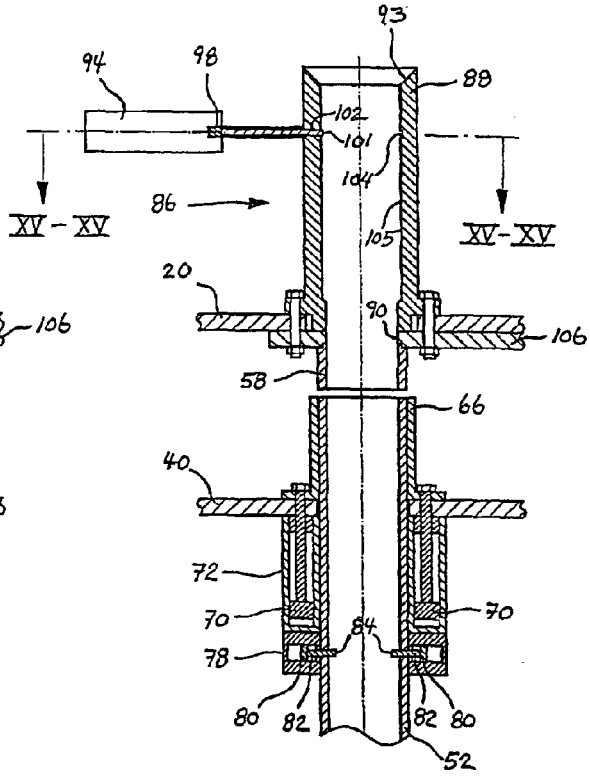
Figure 13:
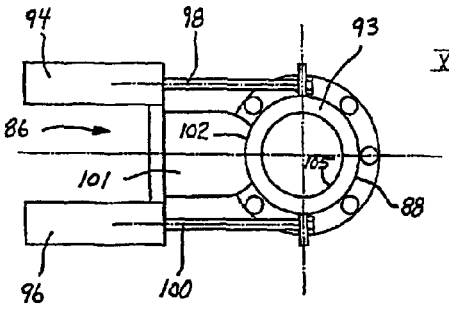
Figure 15:
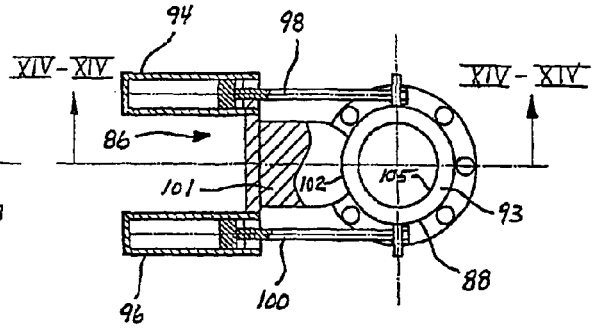

Besides the module frame 20, the intervention module 18 is formed of a drum 30 with a supply string 32 coiled thereon, the drum 30 being secured to the module frame 20 by means of a mounting bracket 34. The supply string is pushed out from or onto the drum 30 by means of a drive wheel 35 driving belts 35' of an injector 36, cf. FIG. 3. The intervention module 18 is formed, moreover, by a tool magazine 38 consisting of two preferably circular and parallel end plates, namely one upper end plate 40 and one lower end plate 42, placed in a horizontal, or approximately horizontal, position in the position of use, and the end plates 40 and 42 being connected, spaced apart, by means of a central rotary shaft 44, the rotary shaft 44 being rotatable about its longitudinal axis, cf. FIGS. 1, 2 and 16. In this exemplary embodiment the rotary shaft 44 has a rotary device arranged thereto, formed by two gears 46 and 48 engaging each other, the gear 46 being connected to the rotary shaft 44, whereas the gear 48 is arranged to a hydraulic motor 50, cf. FIG. 16. Additionally, along the circumferences of the end plates 40 and 42 are connected five longitudinal storage pipes 52 extending through the end plates 40 and 42, each storage pipe 52 containing one downhole intervention tool 54, and the storage pipe 52 being placed in a vertical, or approximately vertical, position and between said end plates 40 and 42. By means of said rotary device the tool magazine 38 may be rotated until the storage pipe 52 containing the desired intervention tool 54 is positioned immediately above and in the extension of the well bore 24, the hydraulic well coupling sleeve 25 and the pipe socket 26, this storage pipe 52 being referred to in the following as the active storage pipe 52.

Moreover, the supply string 32 is placed in and may be passed through a pressure safety device in the form of a lubricator/stripper 56, the lubricator/stripper 56 forming, when the active storage pipe 52 is connected to the well 2, a pressure barrier between this storage pipe 52 and the external environment. The lubricator/stripper 56 is arranged internally in a pipe socket 58, the pipe socket 58 being placed in an above-lying position relative to the tool magazine 38 and in an extension of the well bore 24, the pipe socket 58, like the pipe socket 26, being provided with pressure-sealing seals 60 externally. The free end of the supply string 32 is connected to a coupling head 62 which may releasably be connected to the upper end of the active intervention tool 54, the coupling head 62 being provided with, or having arranged thereto, a solenoid-activated releasable securing device, not shown, and the upper end of the intervention tool 54 being formed with a complementarily shaped connecting nipple 64 for the coupling head 62, to which the coupling head 62 may be releasably connected, cf. FIG. 3. The upper end portion of the active storage pipe 52 is subsequently connected to the pipe socket 58, whereas the lower end portion is connected to the pipe socket 26, each end portion being provided with a separate external displaceable and releasable coupling sleeve 66 and 68. The upper coupling sleeve 66 has several hydraulic cylinders 70 connected thereto, which are arranged in an external and stationary case 72 below, whereas the lower coupling sleeve 68 has several hydraulic cylinders 74 connected thereto, which are arranged in an external and stationary case 76 located above. The hydraulic cylinders 70 and 74 push the coupling sleeves 66 and 68 longitudinally of the active storage pipe 52 and over and round the pipe sockets 26 and 58 and their seals 28 and 60, so that pressure-sealing connections are established between the active storage pipe 52 and the lubricator/stripper 56 and well bore 24, respectively. Then, when the BOP 12 has been opened, the connected intervention tool 54 may be run into the pressurized well 2 and perform the intervention operation without the well pressure being led out to the surroundings through equipment of the intervention module 18, cf. FIGS. 4–7.

Upon termination of an intervention operation the active intervention tool 54 may be pulled out of the well 2 and replaced by another intervention tool 54 which is disposed in another of the storage pipes 52 of the tool magazine 38. The disconnecting of the active intervention tool 54 proceeds in reverse order to the above-mentioned connecting method, after which the tool magazine 38 is rotated until another storage pipe 52 is positioned immediately above and in the extension of the well bore 24, the hydraulic well coupling sleeve 25 and the pipe socket 26 thereof, so that the new intervention tool 54 may be connected to the supply string 32.

In this exemplary embodiment each storage pipe 52 is provided with a releasable tool anchoring device 78 arranged to the upper stationary case 72 of the storage pipe 52, but the tool anchoring device 78 could just as well have been arranged to the lower stationary case 76 of the storage tool 52, possibly another external, separate and stationary case, not shown in the figures of the drawings, placed in a random position along the storage pipe 52. When the tool 54 is not used, the intervention tool 54 is locked within the storage pipe 52 by means of the tool anchoring device 78, so that the intervention tool 54 cannot fall out of the storage pipe 52. When the tool 54 is to be used, the intervention tool 54 is released from the storage pipe 52 by means of the tool anchoring device 78, so that the intervention tool 54 may be run into the well 2 and carry out the intervention operation. The tool anchoring device 78 is formed of four cooperating hydraulic cylinders 80 disposed in the case 72, only two of them being shown in the Figures of the drawings, each hydraulic cylinder 80 being provided with a piston rod 82 which is arranged or formed with a gripping surface 84 at its free end portion, and each piston rod 82 extends into the storage pipe 52 and may, as required, be connected to or released from the intervention tool 54, cf. FIGS. 4–7.

The intervention module 18 of this exemplary embodiment is also provided with a tool loader 86 placed in an immediate above-lying position relative to an inactive storage pipe 52. By means of this tool loader 86 it is possible to replace, in a satisfactory manner, the intervention tool 54 of any storage pipe 52 with another intervention tool 54 which is lowered from the surface vessel. The tool loader 86 is arranged to open/close, so that possible falling objects will not enter the upper and open end portion of the storage pipe 52 underneath. Additionally, the tool loader 86 is so formed that the intervention tool 54 may easily be inserted into or removed from the storage pipe 52 concerned. The tool loader 86 is formed by a short vertical loading pipe 88 disposed above an opening 90 of the upper end plate 40 of the tool magazine 38, the loading pipe 88 being connected at its lower portion to the top side of the end plate 40, and the underside of the end plate 40 being provided with a pipe socket 72 disposed in the extension of the loading pipe 88. Otherwise, at its upper end portion the loading pipe 88 is formed with a tapered inlet opening 93 which facilitates the insertion of an intervention tool 54 into the loading pipe 88. Externally the loading pipe 88 is connected to two cooperating hydraulic cylinders 94 and 96 spaced apart horizontally, piston rods 98 and 100 of the cylinders 94 and 96 being disposed diametrically and secured externally, one on either side, to the upper portion of the loading pipe 88. The two hydraulic cylinders 94 and 96 have an intermediate gate valve 101 fixedly arranged thereto, which is formed by a horizontal-lying and plate-shaped body, semicircular at one end portion, this end portion being insertable by means of the hydraulic cylinders 94 and 96 through a horizontal slot opening 102 of the loading pipe 88, so that the body is connected due to its semicircular shape to a complementarily formed connection groove 104 of the internal pipe bore 105 of the loading pipe 88, so that the pipe bore 105 is closed. The upper and open end portions of other inactive storage pipes 52 are protected from possible falling objects by means of a separate protection plate 106 lying above the tool magazine 38, cf. FIGS. 8–15.

For the rest, the intervention module 18 is provided with a hydraulic pump device 108 containing a hydraulic pump, hydraulic fluid reservoir, associated hoses/couplings and adjusting equipment and control systems/equipment, including signal transceivers, not shown in the figures of the drawings, in order to connect/disconnect, possibly drive and/or control, equipment and components of the intervention module 18, wellhead 4 and BOP 12. Besides, the module 18 is provided with back-up equipment in the form of oil pressure accumulators 110, which should be able to supply isolating parts and equipment of the intervention module 18 and/or the BOP 12 with the necessary activating power, for example in an emergency, the oil pressure accumulators 110 also being incorporated in the above-mentioned adjusting equipment and control systems/equipment and cooperating, to the degree required, with the hydraulic pump device 108. In this exemplary embodiment the intervention module 18 is connected to the surface vessel through a connecting line, not shown, which communicates control and feed-back signals, possibly also acquired well data, between the intervention module 18 and the surface vessel, cf. FIG. 1.

What is claimed is:

1. An intervention module for a subsea well, the module comprising:

a frame provided with a releasable well connecting device for pressure-sealingly connecting to the well;

a drum onto which a supply string is reeled;

a releasable connector provided at a free end of the supply string for connecting to an intervention tool;

an injector for delivering the supply string;

at least one pressure safety device through which the supply string extends;

a rotatable tool magazine provided with at least one storage pipe for containing an intervention tool; and means for driving, controlling, monitoring and securing equipment of the module, characterized in that each end portion of the storage pipe is provided with a displaceable and releasable pipe connecting device for pressure-sealingly connecting to the pressure safety device and the well connecting device, respectively.

2. The module according to claim 1, wherein the storage pipe is arranged between an upper end plate and a parallel lower end plate via a central rotary shaft rotatable by means of a rotary device, each end portion of the storage pipe extending through a respective end plate, said storage pipe, end plates and rotary shaft forming the rotatable tool magazine.

3. The module according to claim 1, wherein the pipe connecting device comprises a releasable coupling sleeve for displacing pressure-sealingly about a pipe socket provided to the pressure safety device and well connecting device, respectively, said coupling sleeve being connected to at least one piston rod displaceable by means of at least one hydraulic cylinder arranged within a stationary case provided externally on the storage pipe.

4. The module according to claim 2, wherein the pipe connecting device comprises a releasable coupling sleeve for displacing pressure-sealingly about a pipe socket provided to the pressure safety device and well connecting device, respectively, said coupling sleeve being connected to at least one piston rod displaceable by means of at least one hydraulic cylinder arranged within a stationary case provided externally on the storage pipe.

5. The module according to claim 1, wherein the at least one storage pipe is provided with at least one releasable tool anchoring device for engaging and holding the intervention tool in its storage pipe.

6. The module according to claim 5, wherein the tool anchoring device is arranged within a stationary case provided externally on the storage pipe, the tool anchoring device comprising at least one hydraulic cylinder arranged within the stationary case and being provided with a piston rod having a gripping surface provided at a free end thereof, the piston rod extending into the storage pipe for engaging and holding the intervention tool.

7. The module according to claim 6, wherein the tool anchoring device is provided to the stationary case connected to the pipe connecting device.

8. The module according to claim 1, wherein the intervention module comprises a tool loader for replacing the intervention tool in a storage pipe when rotated into a predetermined inactive position, the tool loader comprising a loading pipe disposed immediately above the storage pipe.

9. The module according to claim 8, wherein the loading pipe is provided with a tapered inlet at the upper portion thereof for facilitating insertion of the intervention tool.

10. The module according to claim 8, wherein the loading pipe is provided with a valve device for closing a pipe bore in the loading pipe.

11. The module according to claim 10, wherein the valve device comprises two cooperating and spaced apart hydraulic cylinders each having a piston rod connected externally to the loading pipe on either side thereof, said hydraulic cylinders being fixedly connected to an intermediate gate valve forming a plate-shaped body having a semi-circular shape at one end portion thereof, and extending through a slot in the loading pipe, said semi-circular end portion mating with a complementary groove formed internally in the loading pipe for closing the pipe bore when extending the piston rods.

12. The module according to claim 2, wherein the intervention module comprises a tool loader for replacing the intervention tool in a storage pipe when rotated into a predetermined inactive position, the tool loader comprising a loading pipe disposed immediately above the storage pipe and above an opening in said upper end plate.

13. The module according to claim 12, wherein the loading pipe is provided with a tapered inlet at the upper portion thereof for facilitating insertion of the intervention tool.

14. The module according to claim 12, wherein the loading pipe is provided with a valve device for closing a pipe bore in the loading pipe.

15. The module according to claim 14, wherein the valve device comprises two cooperating and spaced apart hydraulic cylinders each having a piston rod connected externally to the loading pipe on either side thereof, said hydraulic cylinders being fixedly connected to an intermediate gate valve forming a plate-shaped body having a semi-circular shape at one end portion thereof, and extending through a slot in the loading pipe, said semi-circular end portion mating with a complementary groove formed internally in the loading pipe for closing the pipe bore when extending the piston rods.

16. The module according to claim 1, wherein a separate protecting plate is provided above the tool magazine for protecting an upper and open end portion of the at least one storage pipe when inactive and positioned outside the tool loader.

17. The module according to claim 1, wherein the intervention module is provided with at least one propulsion unit for positioning the intervention module on the subsea well when being deployed.

18. The module according to claim 1, wherein the connector at the free end of the supply string comprises a releasable solenoid-activated securing device for connecting to the intervention tool.

19. The module according to claim 2, wherein the rotary device comprises two mutually engaging gears, one gear being connected to the rotary shaft and the other gear being connected to a motor.

* * * * *